United States Patent [19]

Spore

[11] 4,422,909

[45] Dec. 27, 1983

[54] ELECTROLYTIC PROCESS FOR THE MANUFACTURE OF ALKALI METAL HALATE

[75] Inventor: Everett M. Spore, Tonawanda, N.Y.

[73] Assignee: Occidental Chemical Corporation, Niagara Falls, N.Y.

[21] Appl. No.: 328,173

[22] Filed: Dec. 27, 1981

Related U.S. Application Data

[62] Division of Ser. No. 104.231, Dec. 17, 1979, Pat. No. 4,332,659.

[51] Int. Cl.[3] ..... C25B 1/24

[52] U.S. Cl. ..... 204/95; 204/237

[58] Field of Search ..... 204/95

[56] References Cited

U.S. PATENT DOCUMENTS

| | | | |
|---|---|---|---|
| 2,204,506 | 6/1940 | MacDougall | 204/95 |
| 3,385,779 | 5/1968 | Nishiba et al. | 24/95 |
| 3,516,918 | 6/1970 | Grotheer et al. | 204/95 |
| 3,539,486 | 11/1970 | Fleck | 204/95 |
| 4,046,653 | 9/1977 | de Nora et al. | 204/95 |
| 4,087,344 | 5/1978 | Casson et al. | 204/278 |
| 4,108,756 | 8/1978 | de Nora et al. | 204/95 |
| 4,173,525 | 11/1979 | Nakamtsu et al. | 204/95 |
| 4,194,953 | 3/1980 | Hatherly | 204/95 |
| 4,332,648 | 6/1982 | Spore | 204/95 |
| 4,332,659 | 6/1982 | Spore | 204/237 |

*Primary Examiner*—T. Tung

*Attorney, Agent, or Firm*—James F. Tao; William G. Gosz

[57] ABSTRACT

An electrolytic apparatus for the production of an alkali metal halate, such as sodium chlorate, from an aqueous solution of alkali metal halide, such as sodium chloride, includes vertical anodes and cathodes in alternating relationship in a housing, and an upwardly oriented flow directing funneling chimney structure in the housing and over the electrodes, through which, electrolyte between the electrodes rises, passing from a wider portion of the funnel to a narrower part thereof, and a connected chimney passageway, from which it is returned for recirculation to a location below the electrodes after removal of gas from it. Different structures of the electrolytic apparatus or cell are specifically disclosed, in one of which the electrolyte, after having passed through the funnel structure, moves longitudinally with respect to the cell, and in the other of which it moves transversely. Also disclosed are apparatuses of the types mentioned which include a plurality of the described funnel devices. Methods for the manufacture of alkali metal chlorate by utilization of such apparatuses are also described. Additionally, several improvements in electrodes structures, joinders of electrodes to conductors, spacings of electrodes and sealings of electrodes, conductors and cell parts are illustrated.

1 Claim, 5 Drawing Figures

ELECTROLYTIC PROCESS FOR THE MANUFACTURE OF ALKALI METAL HALATE

This is a division of application Ser. No. 104,231, filed Dec. 17, 1979 now U.S. Pat. No. 4,332,659.

This application relates to the manufacture of alkali metal halates, specifically sodium chlorate. More particularly, it relates to making sodium chlorate in a new and improved apparatus and by a new and improved process wherein the efficiency of electrolysis is improved, chemical conversion of caustic and chlorine to hypochlorite and subsequent conversion of that to chlorate are promoted and the undesirable and less efficient electrolytic production of chlorate and oxygen is inhibited.

Electrolytic cells for the manufacture of chlorine and sodium hydroxide from brine are well known. In such cells, chlorine is produced at the anode and sodium hydroxide is manufactured at the cathode. Because chlorine and sodium hydroxide react chemically to produce sodium hypochlorate, in chlorine cells membranes or diaphragms or other suitable separating means are interposed between the electrodes to prevent such reactions. In chlorate cells, on the other hand, no such separators are employed between anodes and cathodes, and chemical reaction between chlorine and caustic, to form hypochlorite (from which chlorate may subsequently be manufactured), is promoted. After conversion of brine to hypochlorite converting hypochlorite to chlorate is normally not speedy enough to allow the complete production of chlorate from the chlorine and caustic without recirculation and therefore, recirculation of the electrolyte is effected. Also, retention of such electrolyte, containing unreacted hypochlorite, in a non-electrolytic area of volume, wherein the speed of movement of the electrolyte is diminished, is often desirable to give time for conversion of hypochlorite to chlorate. In some cases the electrolyte, containing the hypohalite is withdrawn from the cell apparatus and is maintained at proper reaction conditions (for halate formation) in a retaining tank or reactor external to the cell, from which it is subsequently fed back to the cell for further reaction to increase the hypohalite (and halate) concentration thereof. However, it is considered preferable for chlorate cells to be complete in themselves, without the need for the supplementary external processing vessels, and it has been found to be desirable for the electrolysis of the brine and the chemical reactions of chlorine and caustic and of hypochlorite to be conducted within the body of the electrolytic apparatus.

In accordance with the present invention an electrolytic apparatus for the production of alkali metal halate therein from an electrolyte, which is an aqueous solution of an alkali metal halide, comprises a housing, a plurality of upwardly and parallelly oriented anodes and cathodes in alternating relationship in such housing, such that the products of electrolysis at the anodes and cathodes can be in contact in the electrolyte and between the electrodes, where they can react to form hypohalite, an upwardly oriented flow directing funneling chimney structure in such housing, extending over such electrodes and narrowing to a passageway, through which passageway electrolyte from between such alternating anodes and cathodes, containing hypohalite, rises, due to the lifting power of hydrogen generated between pairs of such electrodes during electrolysis of the alkali metal halide solution, and in which passageway the electrolyte, containing hypohalite, of a plurality of sets of anodes and cathodes, or unit cells, mixes, means for removing from the interior of the housing at the top thereof at least a portion of the hydrogen generated and passed through the passageway, and return means, within the housing, for slowing the flow of electrolyte, from which hydrogen has been at least partially removed, so that hypohalite is converted to halate, and for returning said electrolyte, containing halate, to the bottoms of the unit cells, for subsequent upward movement through them. Also within the invention are various improved sealing and spacing aspects of the invention and an assembly of a plurality of sets of electrodes plus funneling chimney structures in a single cell housing. A method for manufacturing halates, using an apparatus of the invention, is another aspect thereof.

In searches made in the United States Patent and Trademark Office for art relevant to the invention described herein, including the several aspects thereof, among the more relevant patents found were the following: U.S. Pat. Nos. 2,204,506*; 3,385,779; 3,451,906; 3,463,722*; 3,518,180; 3,539,486*, 3,679,568; 3,732,153*; 3,766,044; 3,785,951; 3,819,503; 3,884,791; 3,902,985; 3,919,059; 4,046,653*; and 4,134,805. The most relevant of these patents are those marked with asterisks, which are discussed below.

U.S. Pat. No. 2,204,506, at column 1, lines 33–46, recognizes the fact that hydrogen produced in the electrolysis of brine serves to promote upward circulation of electrolyte, which is considered to be desirable. U.S. Pat. No. 3,463,722 discloses flow rates of electrolytes past bipolar electrodes. U.S. Pat. No. 3,539,486 describes a cell having hydrogen bubbles which maintain intra-cell circulation of electrolyte at desired velocities, but the patent teaches use of an external reactor for the production of chlorate from hypochlorite. U.S. Pat. No. 3,732,153, assigned to the assignee of the present inventor, teaches the lifting of electrolyte past electrodes by gaseous hydrogen produced in the electrolysis of brine, and at column 5, lines 34–41, it is mentioned that an advantage in having individual vertically directed passages above the electrode pairs is that electrolyte circulates most rapidly in those areas where the most gas is being generated (where the reaction is proceeding at the greatest rate). Finally, U.S. Pat. No. 4,046,653 teaches the importance of high speed circulation of electrolyte past the bipolar electrodes thereof. This patent mentions that prior art apparatuses adopted Venturi connections to avoid counter-recirculation effects of sluggish motion but the patent also mentions that such connections result in higher hydraulic energy losses in the circuit and reduce the electrolyte speed in the electrolysis gap. In summary, the various most relevant patents mentioned recognize that slow passage of electrolyte through the electrolysis gap results in electrolytic chlorate production, oxygen development and loss of efficiency. None of the patents describes the present embodiments of the invention wherein a reducing or funneling chimney-type of structure is employed to promote desirable electrolyte flow in the cell so that the electrolyte made is mixed thoroughly soon after electrolysis, without severe back pressure being generated, and wherein chlorate is chemically produced from hypochlorite in the portions of the cell wherein electrolyte movement is intentionally slowed.

The invention will be readily understood by reference to the description in this specification, especially that following, when taken in conjunction with the drawing, in which:

FIG. 1 is a perspective view of the interior of an apparatus of the present invention, with electrodes, spacers and funneling chimney portion shown, with parts of the apparatus housing being illustrated in phantom to show the location thereof with respect to the electrodes and the funneling chimney, and some of the electrodes and portions of some electrodes being removed for clarity of illustration;

Figure 1:
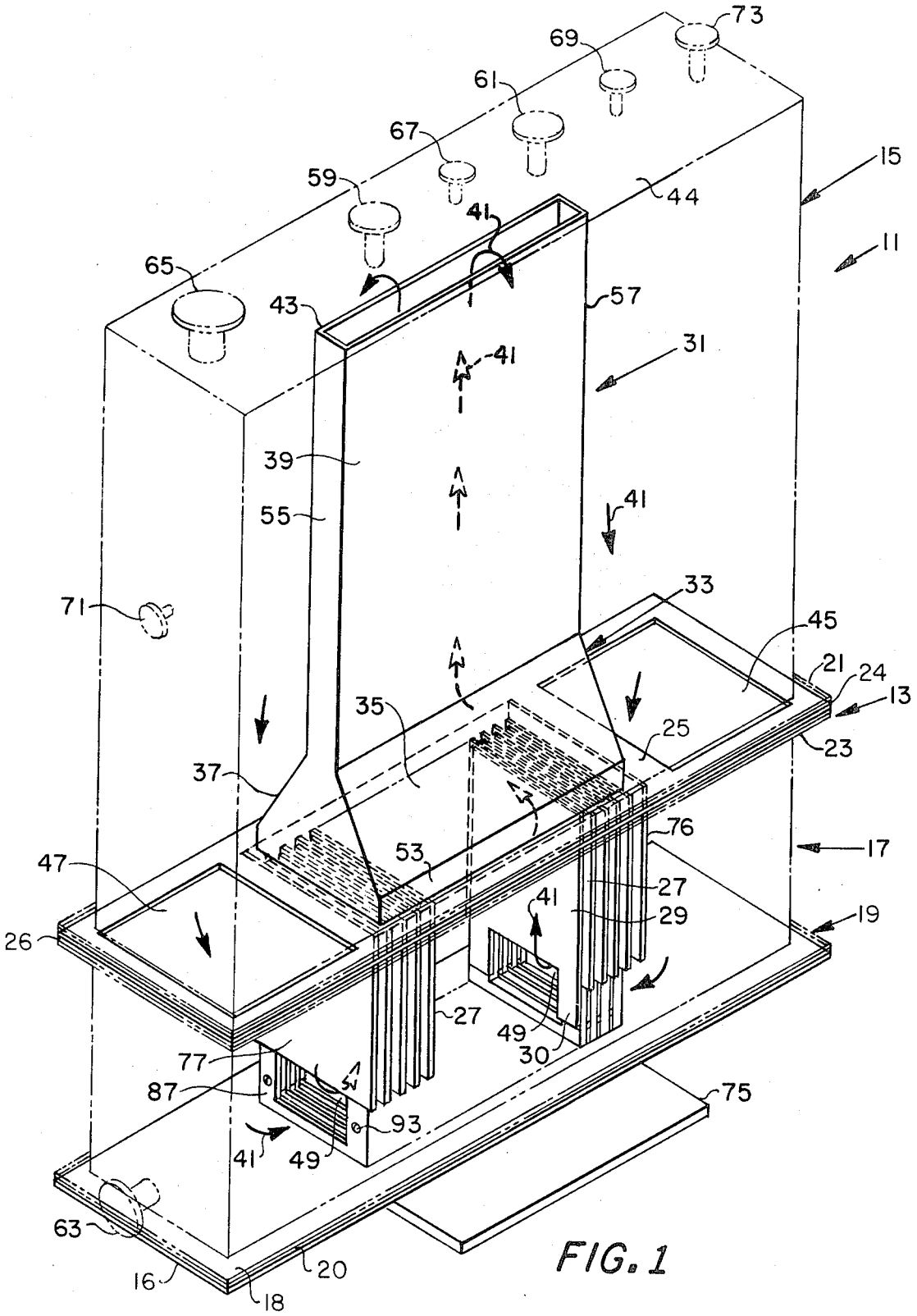

In FIG. 1 electrolytic cell apparatus 11 is illustrated. This apparatus includes a housing 13, composed of walled upper and lower sections 15 and 17, a base 19, flange 21, joined to upper section 15, flange 25, joined to lower section 17, apertured plate means 22 between them, and gaskets 24 and 26 between the plate and the respective flanges. Upper and lower sections 15 and 17, respectively, are held together in liquid-tight contact by bolting or other suitable joinder of flanges 21 and 23, with plate 25 and gaskets 24 and 26 in place between them. Similarly, base 19 includes a base plate 16, a flange 18 from lower housing 17 and a separating gasket 20. Within the apparatus there are shown pluralities of anodes 27 and cathodes 29, arranged in pairs, with clearance spaces between them. It will be noted that anodes 27 are of generally thin, flat, rectangular shape and extend transversely with respect to the longitudinal vertical axis of the apparatus, as do cathodes 29, which are of similar shape, but also include legs 30. However, anodes 27 are in electrical contact with a vertical wall member, not shown well in FIG. 1 but illustrated better in FIG. 3, while cathodes 29, shown better in FIG. 4, are in electrical contact with base 19. The pairs of electrodes are spaced apart desired distances for most efficient electrolysis and removal of electrolytic products upwardly between them, due to the rapid upward flow of generated hydrogen, and to a lesser extent, chlorine.

Above the plurality of upwardly and parallel oriented pairs of anodes and cathodes, in alternating relationship in the housing, is a funneling chimney structure 31, comprising a lower funneling portion 33, which extends over all the electrodes and which narrows down at front portion 35 and at back 37 to a reduced passage 39, which is of a uniform rectangular cross-sectional area and rises to near the top of the apparatus. Funneling chimney 31 fits over an opening in plate 25, which opening, not well illustrated in FIG. 1, but apparent from the upwardly directed flow arrows, permits the flow of electrolyte upwardly from between the electrodes, through the funneling chimney and out the top thereof in the direction illustrated by flow arrows 41 at that location. So as to obtain best flow it is desirable for the clearance area at the open top 43 of the funneling chimney 31 and the housing top 44 at least to equal the open cross-sectional area of such open top at such location, so as to avoid the creation of an undesirable back pressure, which could limit the flow of electrolyte and hydrogen past the electrodes. Also, the cross-sectional area of the passage portion of the funneling chimney is desirably 10 to 40%, e.g., 20%, of the greatest cross-sectional area of the funnel portion.

It will be seen that, due to the structure of the funneling chimney, electrolyte-hydrogen mixture, containing hypochlorite and chlorate, for example, spills over from the top of the chimney and moves down the front, back and ends of the chimney passageway (the downcomer) and toward the apparatus ends, in directions that have significant longitudinal components, so that it may flow through openings 45 and 47 in plate 25. The electrolyte-product mix next passes inwardly toward the middle of the apparatus through paths or openings 49, beneath the electrodes, and upwardly between them, through the funneling chimney, etc. It will be seen that any flow directly downwardly from the top of the funneling chimney (and not toward the ends thereof and through the openings in the plates and gasket) is inhibited because the funneling chimney is joined to or is positioned close to the interior front and back walls of the upper portion 15 of housing 13. Baffles 76 and 77, joined to the underside of plate 23 and the walls of lower housing portion 17, but terminating above bottom plate 16, also help to prevent premature contact of recyclable electrolyte with the electrodes and help to direct it downwardly under the electrodes. Of course, it is recognized that the rapid upward flow of hydrogen also inhibits any downward flow of electrolyte between electrodes, and therefore, sometimes the baffles are omitted. Very preferably, the funneling chimney is connected to plate 25 in such manner that all the electrolyte-gas mixture rising between the electrodes must pass upwardly through the funneling chimney and so that none of the electrolyte-product mix moving downwardly can pass in such direction between the electrodes. In other words, no undesirable conflicting flows of recycling electrolyte containing halate product with upwardly moving electrolyte-gas mixture result and the electrolyte-product and electrolyte-gas-product mixtures follow predictable and designed paths. In FIG. 1 a vertical flange 53 is shown at the bottom of the funneling chimney but such, while desirable, is not necessary and sloping side walls 35 and 37 and lower parts of end walls 55 and 57 may be joined to plate 25 or the ends may be joined to the plate and the sides to the side walls of upper housing part 15, directly or by means of horizontal flanges.

Various openings in the apparatus walls, for feeding materials to the apparatus, for removing materials from it and for various auxiliary purposes, will now be described. Inlets 59 and 61 are for addition of brine to the cell and outlet 63 is for removal of product, including sodium chlorate, some sodium chloride and a minor quantity of sodium hypochlorite. Gas is taken off from the cell through outlet 65 (such gas includes hydrogen and may also include small proportions of chlorine, carbon dioxide, oxygen and nitrogen). Opening 67 is for inert gas purging, as with nitrogen, and opening 69 is an auxiliary or emergency opening for the same purpose. At opening 71 access is provided for connection of internal temperature and level indicators, not shown. Opening 73 is for a spare nozzle, which may be utilized for removal of gaseous products or for addition of electrolyte, modifying chemicals, etc. Other duplicate openings for product removal, gas removal, instrument access and other purposes may also be provided, if desired. As illustrated, the openings are capped but it is understood that those to be employed are opened and are suitably connected to appropriate lines, etc. Of course they will often be equipped with suitable valves.

The entire apparatus of FIG. 1 is shown mounted on a bus 75, which may be of any suitable design but preferably is of steel clad with copper. In commercial use the bus may serve a plurality of apparatuses like those described or to be described (with respect to FIG. 5) or some of each of such apparatuses. In such situation, the feeds and discharges may be from and to header lines or manifolds and in such instances only a few of the apparatuses may be monitored for performance, it being considered that the others are behaving similarly under similar conditions.

Figure 2:
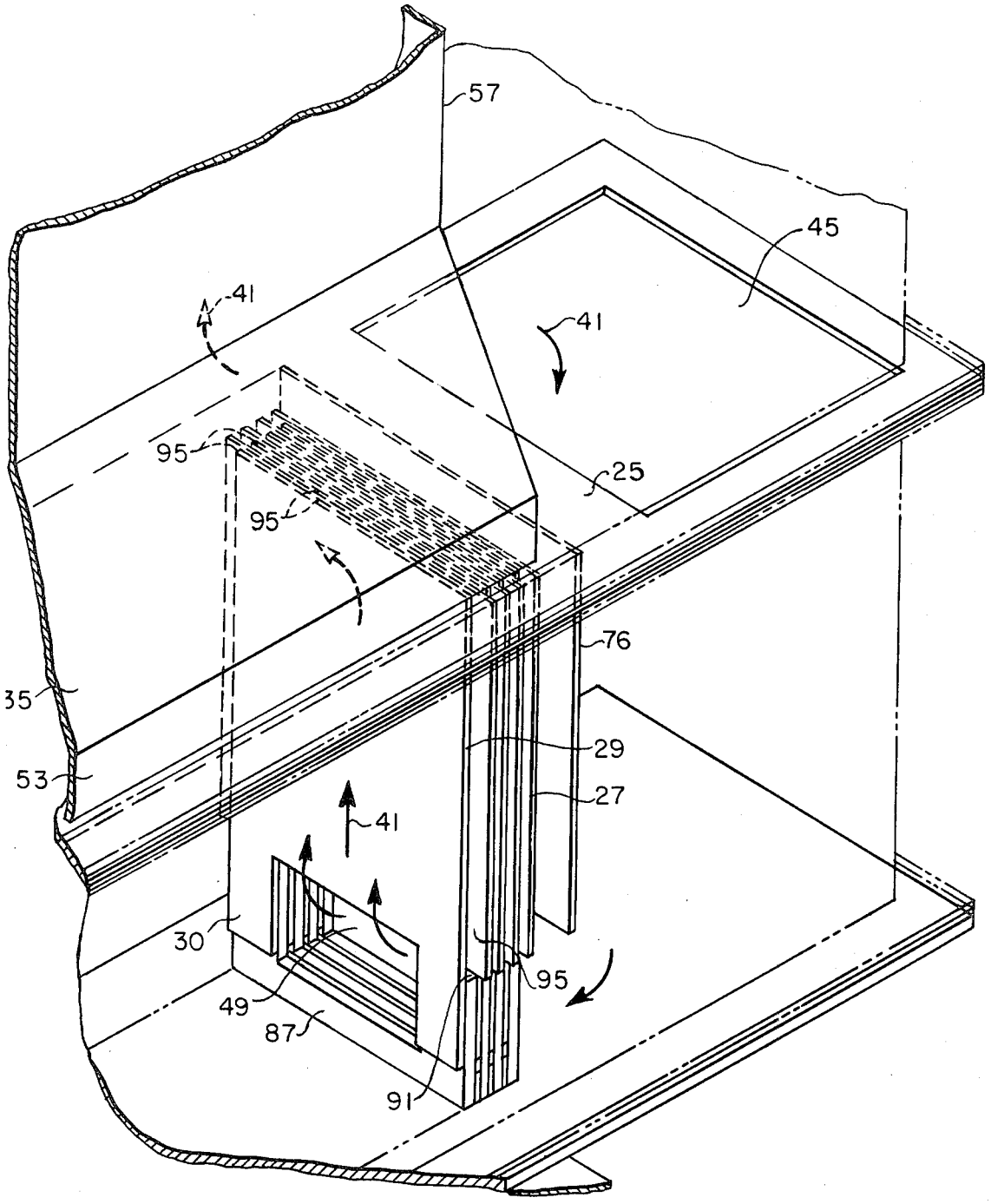
FIG. 2 is an enlargement of a portion of the electrode arrangement of the apparatus of FIG. 1.

In FIG. 2 the relationship between the electrodes is better illustrated than in FIG. 1, due to enlargement of a part of the drawing. However, because FIGS. 3 and 4 illustrate the component parts of the assembly of FIG. 2 (and of a portion of FIG. 1), no separate description of the parts of FIG. 2 will be given, but parts thereof will be referred to in conjunction with descriptions of FIGS. 3 and 4.

Figure 3:
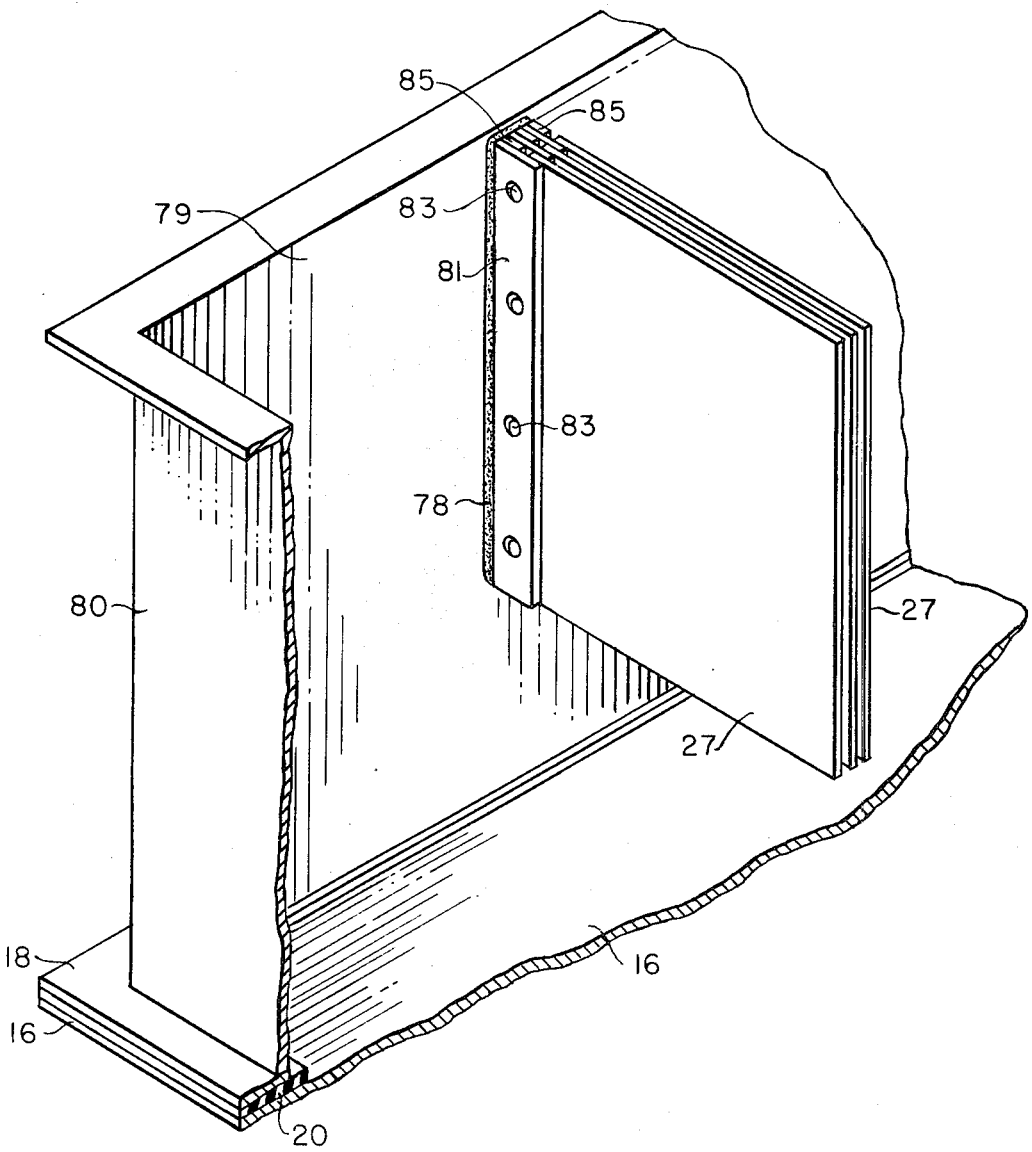
FIG. 3 is a perspective illustration of the supporting of the anodes of the apparatus of FIGS. 1 and 2, by a side of such apparatus.
Figure 4:
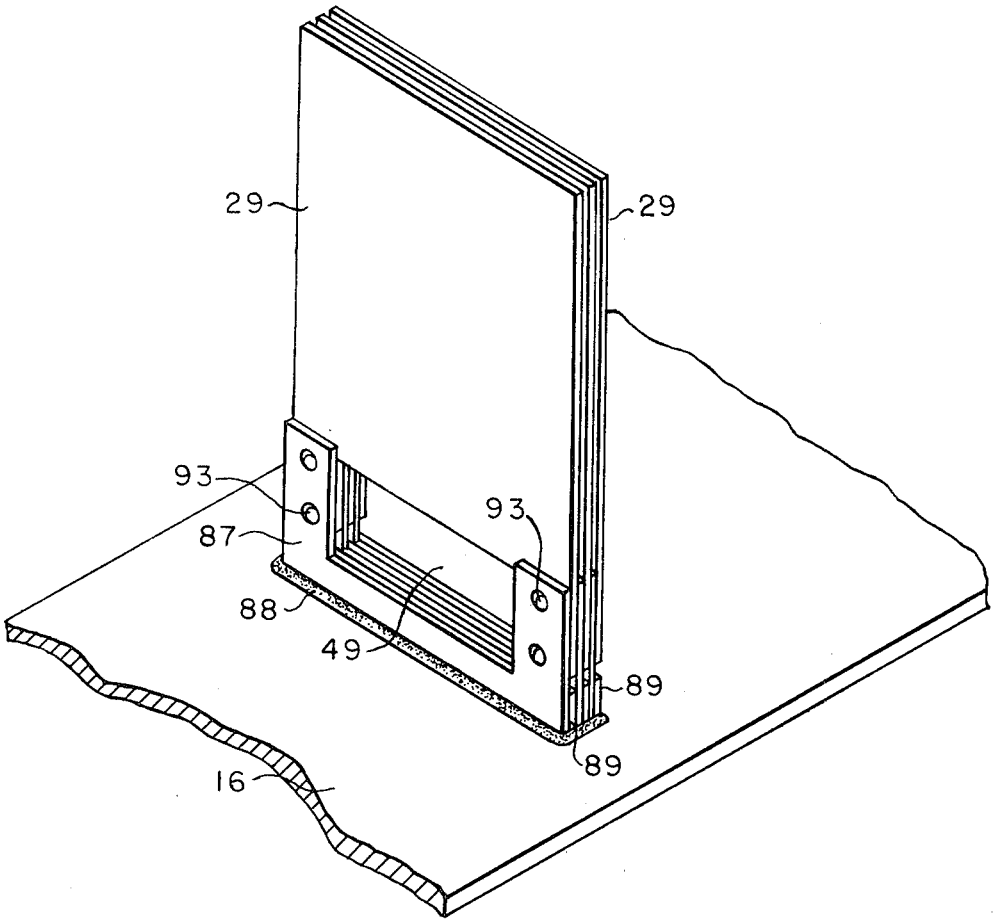
FIG. 4 is a perspective illustration of cathode blades, spacers and clamping pieces of the apparatus of FIGS. 1 and 2, mounted on a base of the apparatus housing.

In FIG. 3 anode blades 27 are shown held to a side wall (the back side wall 79 of lower walled portion 17 of apparatus 11), through which electricity is conducted to the anodes. However, the anodes may also be supported, and often this is preferable, by an internal bus bar or bus wall connected with an external source of electricity. The mechanism of holding is a plurality of clamping members 81, which are welded to wall 79 at 78 and which are bolted together at locations 83 (bolts not shown) to squeeze them against electrodes 27 to make good electrical contacts. "Sandwich" spacers 85 are provided to balance the holding forces on anodes 27 and to help to limit such forces. As illustrated, anodes 27, with clearance spaces between them for cathodes and electrolyte, are wholly within the lower walled portion 17 of apparatus 11, are above bottom plate 16 thereof and are not in contact with the front wall of the lower walled portion of the apparatus. Thus, the electrical contact to the anodes is through the back wall or through an internal bus bar or other suitable conductor adjacent the back wall. If desired individual connections to the anodes could be made from an external bus bar but this can result in excessive gasketing being needed, with increased chances for leaks. Note that in FIG. 3 the back wall 79 and side wall 80 of lower housing part 17 are flanged, as at 18. Also, the anodes may be connected to a front bus, too, thereby, especially for larger anodes, allowing more equal conduction of electricity from two sides to the anode middle.

In FIG. 4 the cathode assembly structure is illustrated, with cathodes 29 being held in electrical contact with bottom plate 16 of base 19 by means of clamping pieces 87 and spacers 89. Clamping pieces 87 are fastened to base plate 16 by suitable means, e.g., welding 88, and thus are in electrical contact with such base. The clamping pieces are flat and of U-shape, with the U extending upwardly, in normal orientation, and transversely with respect to the longitudinal vertical axis of the apparatus. The U terminates short of the location of the anodes, as may be seen in FIG. 2, so that there is a clearance 91 (FIG. 2) between them. It will be noted that cathodes 29, at the bottom thereof, are of a corresponding U-shape, but inverted, with the "legs" 30 of the U matching those of the clamps. The clamps 87 are bolted together by bolts through openings at locations 93 to hold the cathodes and the conductive clamping pieces together. Spacers 89 even out the bolting forces and help to prevent excessive bolting pressures being applied. As illustrated, the spacers for the cathode clamps are welded to the apparatus bottom and those for the anode clamps are fastened to a side. Due to the U structures of the cathode clamping members and the cathodes and their fastenings together at the legs of such U's, there is created a path or opening 49, through which electrolyte may flow from the apparatus ends and then move upwardly between the various pairs of electrodes, through clearances 95 (FIG. 2) between them.

Figure 5:
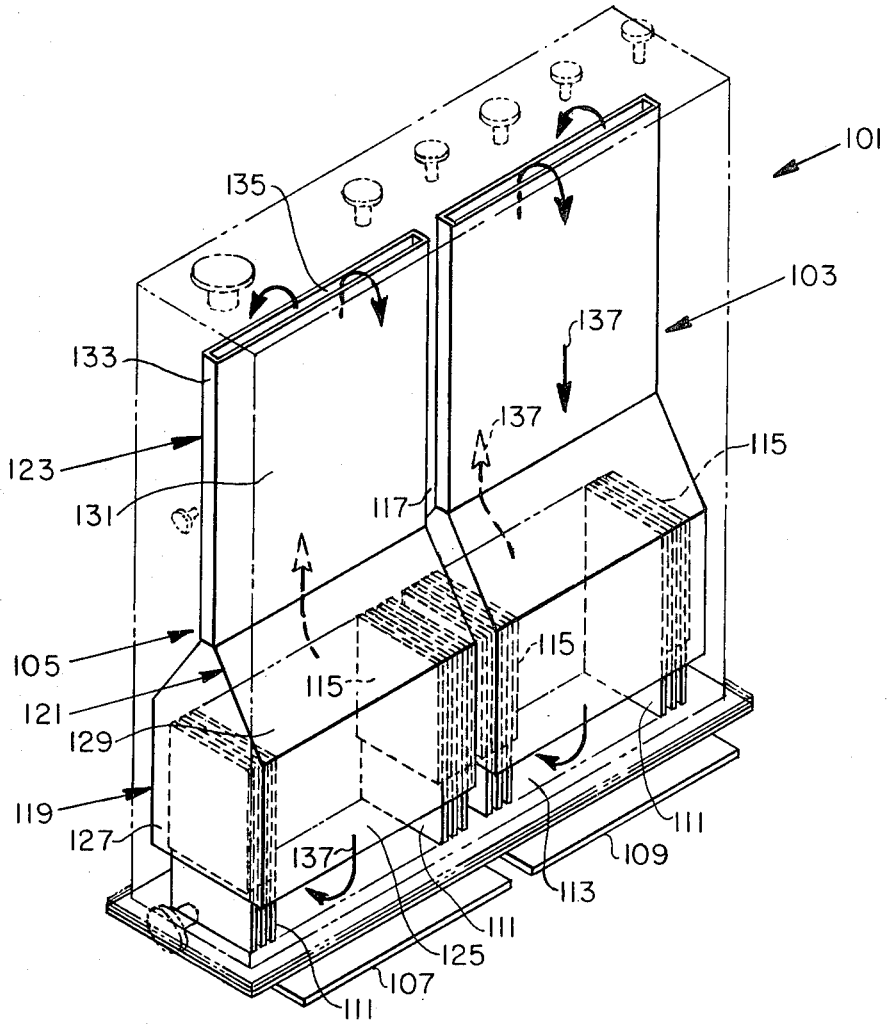
FIG. 5 is a perspective view, of the type of FIG. 1, but showing a plurality of funneling chimneys of a different type, in a cell housing.

In FIG. 5 a different electrolytic cell apparatus 101 is illustrated, in which plural funneling chimney structures 103 and 105 are present, similar to but different from that of FIGS. 1 and 2. Externally, the apparatus appears similar, except for the provision of dual buses or copper conductors 107 and 109 and no separator plate 25, flanges 21 and 23 and gaskets 24 and 26 of the apparatus of the earlier figures; hence no specific descriptions of inlets, outlets, access openings and apparatus bottom will be given herein, the descriptions thereof with respect to FIG. 1 being adopted. However, the interiors of the apparatuses are significantly different, despite the fact that they both include alternate arrangements of flat anodes and cathodes and funneling chimneys over them, designed to create desirable circulation of electrolyte and a sufficient hold-up time for hypochlorite to be converted to chlorate.

In apparatus 101 a plurality of cathodes 111 is illustrated, joined to apparatus bottom 113, so that electricity is conducted from said bottom to said cathodes. Anodes 115 are fitted between cathodes 111, leaving clearance spaces for electrolyte between the various anode and cathode surfaces. Anodes 115 are physically and electrically joined to a suitable support, such as a wall of the apparatus, an internal bus bar, an external bus bar or other suitable means. Funneling chimneys 103 and 105 are each in position covering the anodes and cathodes in their areas of the apparatus, leaving a clearance 117 between the chimneys, relatively small clearances between the chimney ends and the interior end walls of the electrolytic apparatus, and additional clearances between the shrouding sides 125 and the interiors of the side walls of the apparatus.

Because funneling chimney 103 is essentially the same as that designated 105 the following description of chimney 105 also applies to chimney 103. Funneling chimney 105 includes shrouding, reducing and passageway sections 119, 121 and 123, respectively. Shrouding section 119 includes side walls 125 and lower portions of end walls 127. Reducing section 121 includes tapering surfaces 129 and the upper portions of ends 127. (Of course, these parts are duplicated but are only being described and illustrated with respect to single sections thereof). Passageway section 123 includes sides 131 and ends 133, with an opening 135 in the top thereof, for withdrawal of electrolyte-product-gas mixture from passageway 131. There is a sufficient clearance between the passageway and the interior of the top of the apparatus to allow flow of electrolyte out of the passageway without significant back pressure development. Thus, the area for flow of the fluid out of the passageway should be at least equal to the internal cross-section of the passageway at the top thereof. Shroud portion 119 of funneling chimney 105 extends below the bottoms of anodes 115 and thereby regulates flow of the electrolyte-product mix past the electrodes. Thus, as the electrolysis proceeds, electrolyte, hypochlorite and hydrogen gas (and other gases and chemicals present) rise between the electrodes, due mostly to the low density of the gases, and are blended as they pass through the funneling portion of the chimney and up through the passageway, with the linear velocity in the passage being less than that of the electrolyte traveling past the electrodes, often being from 0.2 to 0.8 times such velocity. Thus, the electrolyte, containing chlorine, caustic, hypochlorite and hydrogen, moves very quickly through the electrolytic space and then slows down in the funneling chimney, where the hydrogen bubbles coalesce to an extent, so that improved mixing is obtained in the chimney, especially in the upper passage portion thereof. After spilling over of the liquid from the top of the passage and after removal of at least some of the gas from the apparatus, the electrolyte (including product) moves downwardly through the downcomer portion of the apparatus at a diminished rate, due to the much greater cross-sectional area of the apparatus section through which it is passing. This allows additional time for the hypochlorite present to be converted to chlorate, by what is essentially a time and temperature controlled rearrangement reaction, $3\ NaOCl \rightarrow NaClO_3 + 2\ NaCl$, preferably conducted at 90° to 95° C. Then, the electrolyte-product liquid mix flows upwardly past the electrodes for further electrolysis and production of more hypochlorite. Essentially the same reactions and conditions obtain when the apparatus of FIGS. 1-4 is used.

In the embodiment of the invention illustrated in FIG. 5, a pair of chimneys is present, each of which covers its own set of electrodes, but, if desired, only one such structure may be employed or a greater plurality thereof e.g., 3 to 8, may be utilized. Also, the arrangement may be made differently, as by having the longitudinal axes of the chimneys parallel to each other but not coaxial. With the plurality of sets of unit cells, as illustrated, advantages obtained are in the blending of products from both sets to produce a more uniform chlorate solution in the apparatus, and in being able to employ smaller chimney structures (larger ones may require heavier constructions, etc.). The shroud or skirt portions of the funneling chimneys may utilize the apparatus wall on one side thereof as a component part but this will diminish the circulation of electrolyte about that side and so is not preferred. The invention may utilize a single penetration through the apparatus side wall for admission of an electrical contact to the anodes, plus an internal bus bar which communicates with each of the anodes, but dual bus bars, etc., are also contemplated. Circulation of electrolyte will be as illustrated in FIG. 5, following the paths of arrows 137.

The materials of construction of the various components of the present invention are known to those familiar with the art and are available. The cell box or apparatus housing or enclosure may be of any suitable materials of construction, including carbon steel, titanium, polypropylene, chlorinated polyvinyl chloride coated steel, PTFE coated steel and titanium clad steel. The internal plate of the apparatus of FIG. 1 and the base plates may be of similar materials, with carbon steel usually being preferred. The funneling chimney and shroud or skirt structures may also be of similar materials. Sometimes, it may be preferred to utilize fiberglass reinforced polymers for apparatus parts. Normally, anodes and cathodes may be of the same types as are usually employed in chlorate cells. For example, platinum-iridium plated titanium anodes and carbon steel cathodes are useful, although various other well-known anode and cathode materials may be used instead. One preferred coating on the titanium anode is a 70:30 platinum:iridium composition but such proportion may be varied and platinum-ruthenium, ruthenium oxide and mixed ruthenium oxides coatings may also be employed. Such and other preferred anodes are those known in the trade as dimensionally stable anodes. The cathodes used may be in solid or mesh form, with the latter frequently being preferred, and with the preferred material of construction being steel. Various connectors, such as internal bus bars, may be of titanium coated copper (highly preferred) but any suitable conductor that will stand up to the environment may be utilized. Gaskets employed will preferably be of EPDM (polymer of ethylene propylene diamine monomer), PTFE, polychloroprene or silicone rubber but it is within the invention to utilize other synthetic organic polymers, providing that they are of sufficient sealing power (elastomeric polymers are preferably employed). Among such other suitable plastics are the polyurethanes, polyethylene, polypropylene and polyvinyl chloride. When EPDM is used (preferred), it is preferably peroxide cured.

The described apparatuses will usually operate at temperatures in the range of 10° to 95° to 100° C., preferably 70° to 95° C. and more preferably 80° to 95° C., at a difference of 1.8 to 4.5 or 5 volts, preferably 1.8 to 3 volts e.g., 2.2 to 2.8 volts, and a current density in the range of 0.1 to 0.7 ampere/sq. cm., preferably 0.1 to 0.5, more preferably 0.1 to 0.3 ampere/sq. cm. of anode surface, most preferably of 0.2 to 0.3 ampere/sq. cm. The cells are preferably low current density cells of improved operating efficiencies. The charge of brine to the cell will normally be at a concentration of sodium chloride in the range of 180 to 350 g./l., preferably 290–320 g./l., and the concentration of sodium chlorate being removed will be in the range of 250 to 750 g./l., preferably 350 to 750 g./l. and most preferably about 600 to 700 g./l. Such chlorate solution will also usually contain from about 80 to 160 or 200 g./l. of sodium chloride, preferably 100 to 160 g./l. thereof and 0.5 to 10 g./l. of sodium hypochlorite, preferably 1 to 6 g./l. and more preferably 2 to 6 g./l. To improve cell operation it is desirable to have dichromate ion present and accordingly, the electrolyte may contain from 0.5 to 10 g./l. of $Na_2Cr_2O_7$, preferably 1.5 to 3 g./l., and often about 2 g./l. The desirable velocity in the passageway at the top of the funneling chimney structure, for best flow and mixing in that passage and in the reducing funnel portion, will often be in the range of 20 to 100 cm./second and may preferably be from 35 to 70 cm./sec.

Under the conditions described, an assay chlorate efficiency in the range of 90–99% is obtainable, with such efficiency usually being in the range of 95 to 98%. Such efficiencies can be obtained utilizing platinum-iridium or equivalent coatings on titanium, with the proportions of platinum and iridium being 7:3, and at operating temperatures up to about 90° C., above which the efficiencies may be diminished somewhat.

In a typical cell of a type shown in FIG. 1 (and also in FIG. 5) the desired ratio of the chimney passage velocity to the velocity in the surrounding volume of the apparatus will usually be from about 2.5:1 to 50:1, preferably being in the range of 2.5:1 to 10:1. Such velocity ratios result in good mixing of the electrolyte, product and gases in the chimney passage, so as to further promote reaction of unreacted components thereof, while yet allowing a holdup time in the surrounding volume sufficient to allow conversion of hypochlorite to chlorate at a significant rate. Under the conditions of operation and with the apparatuses described it is found that the hydrogen produced contains less than 3% of oxygen on a volumetric basis, preferably less than 1.5% thereof, indicating that there is little undesirable electrolytic production of chlorate or halate and oxygen, and the proportions of other gases such as chlorine, carbon dioxide and nitrogen are smaller yet.

In an apparatus like that illustrated in FIG. 1, measuring three meters in height by 2.3 m. long by 0.6 m. wide, wherein the funneling chimney is about 2 m. high and the passage thereof is about 0.1 m. wide, equipped with 81 anodes and 80 cathodes, taking 100,000 amperes current flow at a voltage of about 2.8 volts and operating 330 days per year, 24 hours per day, about five hundred metric tons per year of sodium chlorate will be produced. The flow rate through the chimney passage during such operation will usually be in the range of about 4,000 to 6,000 liters per minute at a temperature in the range of 80° to 95° C., and such a rate is obtainable without the need for pumping equipment. It will be seen that this rate is equivalent to about 1 to 2 volume changes per minute per minute but from 0.3 to 5 changes will also be workable, depending on the circumstances.

Low current density chlorate cells of the present types are advantageous for many reasons, several of which have already been mentioned. Primarily, utilizing simple structures, comparatively easy to fabricate, install and service, they make it possible to produce halates efficiently and economically. Incidentally, "halate" is intended to cover chlorates of sodium and potassium, and other operative cations, and the bromates and iodates to the extent operative. The massing of a multiplicity, usually from 10 to 200, e.g., 20 to 100, electrodes under a single collector structure saves complex fabrication of individual chimneys covering as few as two to eight electrodes and makes the chimney passage less liable to become blocked with sediment, corrosion products and foreign matter that may have entered the apparatus. The funneling structure and the reduced cross-sectional area chimney communicating with it, result in a desirable mixing of the chlorine and caustic, promoting reaction thereof; yet, the larger volume of the apparatus, which slows the flow of liquid, facilitates chlorate production from the hypochlorite. Hydrogen gas, which is withdrawn at the top of the apparatus, promotes the flow and intermixing of the reactants in the area between the electrodes and in the funneling chimney but, because it is withdrawn at the top of the apparatus, does not interfere with the production of chlorate from hypochlorite. The flow paths illustrated in the drawing, with respect to the embodiments of the invention shown in FIGS. 1 and 5, assure that there will be no undesirable intermixing of electrolytes, with no downward flow being between the electrodes, and also assure that the electrolyte will continuously be recycled upwardly past such electrodes, at a desired velocity and without any "dead" locations in the apparatus, which could result in oxygen generation, electrolytic production of chlorate and efficiency losses. Due to the construction of the described apparatuses it will be clear that leakage through multiplicities of gaskets around conductors to individual electrodes will be minimized. Furthermore, disassembly and servicing of the apparatuses is facilitated by the described structures. For example, with respect to the apparatus of FIG. 1, servicing may be effected easily by merely lifting off the upper portion of the apparatus housing, which permits access to the electrodes, for removal, replacement or repair. The prevention of product leakage is important because with many chlorate apparatuses excessive time is spent in replacing gaskets, especially where the anode conductors enter the apparatus. The present method eliminates anode end seals and plural flange or cover plate seals, making the various electrical connections internal and thereby reducing the number of possible leakage points. Power costs are lowered in the present invention by accurate location of the anode material at a desirable close distance from the cathode material, using low current density and thereby reducing the voltage. Electrode costs are reduced because no bends are needed in the anode material, thereby facilitating easier recoating of electrodes and eliminating some of the more costly components of such apparatuses, e.g., multiplicities of titanium clad copper conductor rods and titanium reinforcements. Also, the internal structure of the cell facilitates replacement of the cathodes as they wear out, usually due to corrosion or hydrogen blistering. The cell construction is simplified and closer tolerances can be met without employing time-consuming methods, normally required for electrolytic cell renewals. The employment of spacers and clamps, such as those illustrated, helps to maintain the desired tolerances and clearances. Another advantage is in the interchangeability of the apparatuses of the different types shown in FIGS. 1 and 5.

Various modifications of the invention may be employed, some of which have been alluded to previously. Thus, as in FIG. 5, wherein a plurality of chimneys is present in the apparatus, so too can a plurality of the chimneys of FIG. 1 be utilized, if desired. The chimney structure, in the funneling portion thereof, may be further modified to diminish longitudinally and upwardly, as well as transversely and upwardly or may diminish only longitudinally and upwardly. Also, the passage portion may diminish longitudinally and upwardly. However, such constructions are not preferable and do not appear to result in the most desirable fluid flow. The distances between the chimneys and passages of the plurality of funneling chimneys of FIG. 5 may be modified but normally such distances will be only small percentages, e.g., 2 to 20%, preferably 2 to 7% of the total longitudinal lengths of the passages between which the clearances are located. Similar percentages apply to the distances between the end walls of the housing and the funneling chimneys and usually the total passageway length will be at least 70%, e.g., 80 to 95% of the length of the apparatus. In some cases, no clearances may be present between the different funneling chimneys of FIG. 5 or between the chimney(s) and the end walls. The funneling portions of the funneling chimneys may be suitably curved, rather than straight walled and similarly, the shapes of various other part of the apparatus may be changed. The locations of openings in the apparatus for the additions and removals of materials may be altered. The shapes of internal passageways in the plate between the upper and lower housing sections of the apparatus of FIG. 1 may be changed, as may be the open area thereof but normally such area will be 50 to 95% of that available between the end walls of the funneling chimney and those of the apparatus. The shapes of the cathodes and the cathode clamps and spacers may be altered so that the shape of the passageway under the electrodes for flow of electrolyte to positions where it may move upwardly between the electrodes may also be altered but normally a rectangular shape, such as that illustrated, is highly preferred. Similarly, the shapes of any baffle structures may be modified and sometimes the baffles will be omitted, with the end electrodes and clamps serving, in effect, as baffles. If velocities are too low from gas effects alone a supplementing pump may be employed but this is usually neither necessary nor even desirable. Various other modifications of the apparatus may also be made, without departing from the teachings herein.

The process aspect of this invention will now be described in the following example. However, it must be understood that the example is only given as illustrative and the invention is not limited to it. All temperatures in this specification are in °C. and all parts are by weight, unless otherwise indicated.

EXAMPLE

An apparatus of the type illustrated in FIG. 1 is utilized, with the housing measuring approximately 3 meters (height) by 2.3 meters (length) by 0.6 meter (width). The various structural parts thereof are approximately to scale but 81 anodes and 80 cathodes are employed. The anodes are dimensionally stable anodes, having a platinum-iridium coating over a titanium base, with the percentages of platinum and iridium being 70% and 30% in the coating. The cathodes are of low carbon steel.

The electrolyte charged to the cell is a brine, having about 300 (290–320) g./l. of sodium chloride in water and also containing about 2 g./l. of sodium dichromate. Before charging the electrolyte the cell is purged with nitrogen and such purging may also be effected while the electrolyte is being added and afterward. The apparatus is operated at a voltage in the range of 2.5 to 4.5 so that the current flow is about 100,000 amperes and the current density is in the range of 0.2 to 0.68 ampere/sq. cm., with the current density for most of the operation being about 0.2 ampere/sq. cm. The flow velocity past the electrodes and up the passageway of the funneling chimney is in the range of 40 to 70 cm./sec. and the temperature of operation is in the range of 70° to 95° C. The flows of electrolyte range from 4,000 to 6,000 liters/minute and the cell is operated steadily. During operation measurements are made of flow rates and it is found that at 70° C. a velocity of 46 cm./sec. is obtained, corresponding to 4,260 l./min. At 90° C. such velocity is 51 cm./sec., corresponding to 4,700 l./min. At such condition the assay chlorate efficiency is in the range of 95 to 98%. At 95° C. the velocity is 61 cm./sec., corresponding to 5,655 l./min. The chlorate production rate is about 70,000 tons per year, calculated on the basis of a 24 hours per day operation for 330 days per year, in a plant having 140 such apparatuses operating. The product obtained may have a concentration of sodium chlorate in the range of 350 to 700 g./l., depending on the concentration desired, with the sodium chloride content being from 80 to 160 g./l. and the sodium hypochlorite content being from 2 to 6 g./l. For example, operating at 90° C., the sodium chlorate concentration is about 550 g./l., the sodium chloride concentration is about 125 g./l., the sodium hypochlorite concentration is about 4 g./l. and the oxygen content of the hydrogen taken off is less than 3%, by volume.

When the apparatus used is that of FIG. 5, with operating conditions maintained about the same, similar good production of chlorate solution is obtained.

The invention has been described with respect to various embodiments and illustrations thereof but is not to be limited to these because it is clear that one of skill in the art, with the present specification before him, will be able to utilize substitutes and equivalents without departing from the invention.

What is claimed is:

1. A method for manufacturing sodium chlorate in an electrolytic cell comprising a cell housing, electrode pairs and an electrolyte which includes an aqueous solution of sodium chloride, which method comprises applying to a plurality of electrode pairs in said cell a voltage of from 1.8 to 3 volts to cause a direct current flow at a current density in the range of 0.1 to 0.3 ampere/sq. cm. of anode surface, with the temperature of the electrolyte being maintained in the range of 10° to 95° C., flowing the electrolyte, including hypochlorite and hydrogen gas, through a common funneling chimney in the cell extending over the electrode pairs, said funneling chimney having a lower funneling portion and an upper passageway portion, removing hydrogen gas from such electrolyte after passage thereof through the passageway, flowing the electrolyte downwardly within the cell housing to the bottom of the cell, during which movement at least some hypochlorite is converted to chlorate, and moving it upwardly through the passageway at a velocity in the range of 20 to 100 cm./second, caused by the lifting power of the hydrogen gas in the passageway, the velocity of electrolyte in the passageway being 0.2 to 0.8 times the velocity of electrolyte traveling past the electrodes, whereby the hydrogen gas produced and removed contains less than 3% of oxygen on a volumetric basis, and continuing the electrolysis and such operations of the apparatus so that the electrolyte, when ready for removal from the apparatus, contains 350 to 700 g./l. of sodium chlorate, 80 to 160 g./l. of sodium chloride and 1 to 6 g./l. of sodium hypochloride, and removing such electrolyte from the apparatus.

* * * * *